United States Patent [19]

Tipton

[11] Patent Number: 4,852,817

[45] Date of Patent: Aug. 1, 1989

[54] MACHINE FOR BREAKING UP FOOD CONTAINERS AND FOR RECOVERING FOOD PRODUCT THEREFROM

[76] Inventor: Walter E. Tipton, 9246 Telegraph Rd., Winnebago, Ill. 61088

[21] Appl. No.: 196,745

[22] Filed: May 20, 1988

[51] Int. Cl.[4] ..... B02C 19/22

[52] U.S. Cl. ..... 241/260.1; 241/DIG. 38

[58] Field of Search ..... 241/260.1, 101.7, 100, 241/79, DIG. 38, 46.17

[56] References Cited

U.S. PATENT DOCUMENTS 2,216,371 10/1940 Leveke ..... 241/46.17 X 4,182,592 1/1980 Henryson ..... 241/260.1 X

FOREIGN PATENT DOCUMENTS 2702653 7/1978 Fed. Rep. of Germany ... 241/260.1

560070 3/1975 Switzerland ..... 241/260.1

*Primary Examiner*—Mark Rosenbaum

*Attorney, Agent, or Firm*—Leydig, Voit & Mayer, Ltd.

[57] ABSTRACT

A machine for breaking up filled containers of milk, cottage cheese and the like after expiration of the freshness date and for recovering the food product for use as animal feed. The machine comprises an auger which rotates in an upwardly inclined barrel and which coacts with angularly spaced ribs in the barrel to break up the containers as they are advanced through the barrel by the auger. A discharge spout at the end of the barrel includes a pivoted gate which may be adjusted to vary the cross-sectional area of the spout and control the rate of advance of the containers according to the size and quantity of the containers. Food product which spills out of the broken up cartons flows downwardly along the barrel and is directed to a collection tank.

13 Claims, 2 Drawing Sheets

MACHINE FOR BREAKING UP FOOD CONTAINERS AND FOR RECOVERING FOOD PRODUCT THEREFROM

BACKGROUND OF THE INVENTION

Upon the expiration of the freshness date of dairy products such as milk, cottage cheese and the like, the product is collected from the retail shelves by the route distributor and usually is returned in its original container to the dairy or processor for disposal. Ecological factors make the disposal of such product difficult. In some localities, disposal of the product through the sanitary system or storm system is prohibited. Moreover, the product must be removed from its container before it is dumped.

In some cases, the stale dairy product is packed in crates and is either sold or donated to farmers who break open the cartons and use the product for feeding hogs and other animals. Dairies, however, are becoming more and more reluctant to use this method of disposal because of the possibility of salmonella resulting from unsanitized empty crates being returned from the farm to the dairy.

SUMMARY OF THE INVENTION

The general aim of the present invention is to provide a new and relatively simple and inexpensive machine for quickly and easily extracting food product from containers in an ecologically safe manner.

A more detailed object of the invention is to achieve the foregoing through the provision of a machine in which an auger uniquely coacts with a barrel to crush and break up the food containers and allow the product therein to drain into a collection tank.

Still another object of the invention is to provide a machine in which the barrel restricts the advance of containers by the auger to cause the auger to break up the containers, the degree of restriction being adjustable for correlation with the type and quantity of containers.

The invention also resides in the comparatively simple and low-cost construction of the machine.

These and other objects and advantages of the invention will become more apparent from the following detailed description when taken in conjunction with the accompanying drawings.

DETAILED DESCRIPTION OF THE PREFERRED EMBODIMENT

Figure 1:
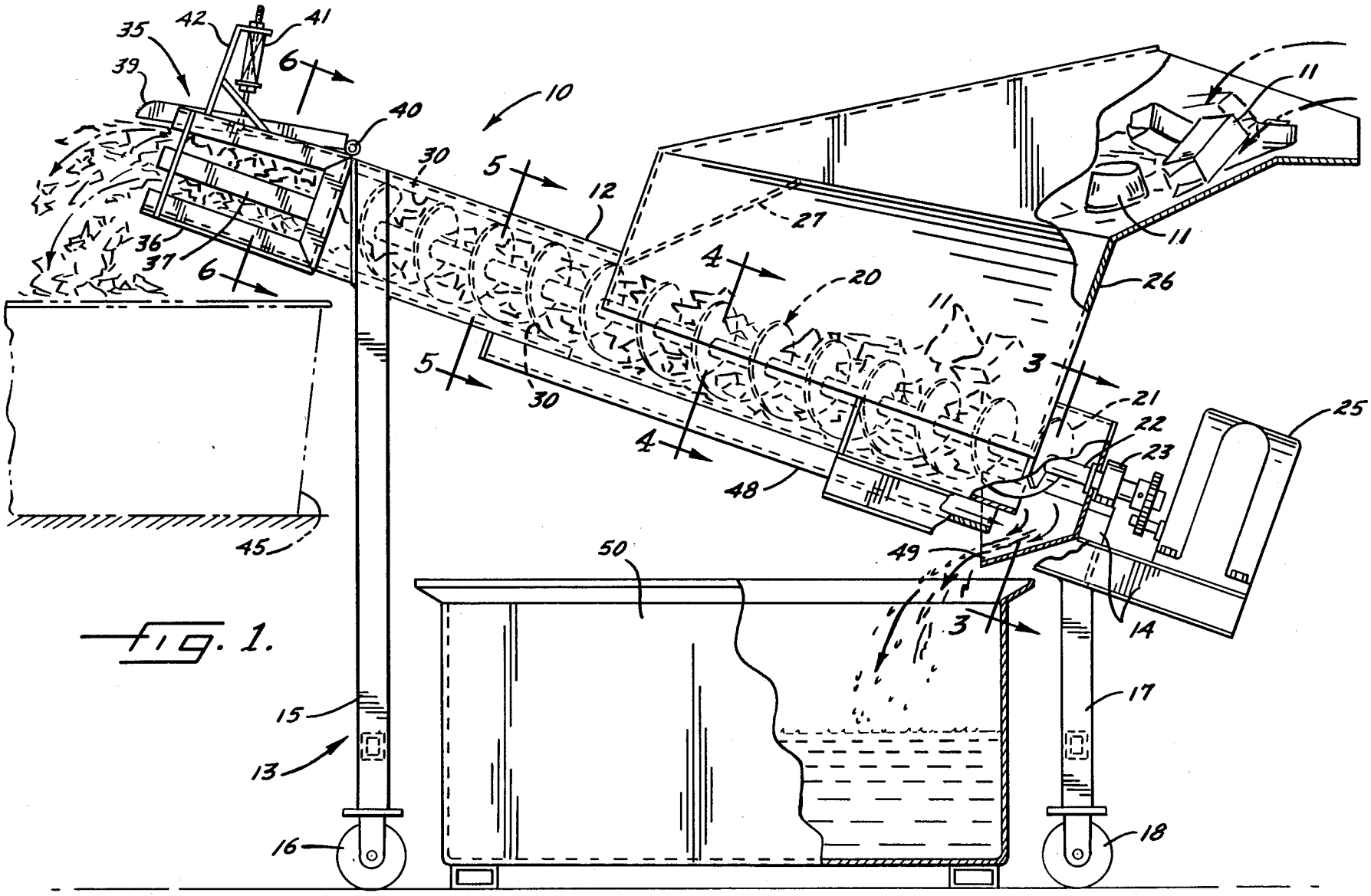
FIG. 1 is a side elevational view of a new and improved machine incorporating the unique features of the present invention.
Figure 2:
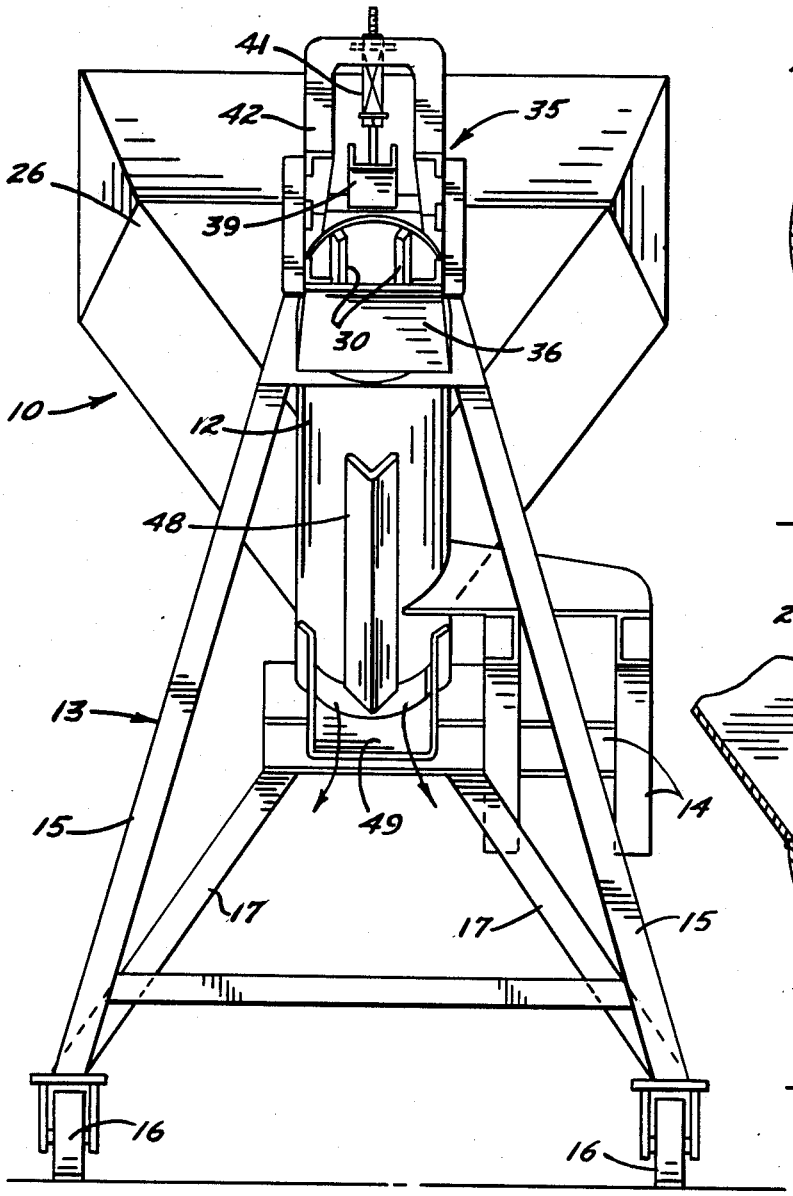
FIG. 2 is an end elevational view of the machine as seen from the left of FIG. 1.
Figure 3:
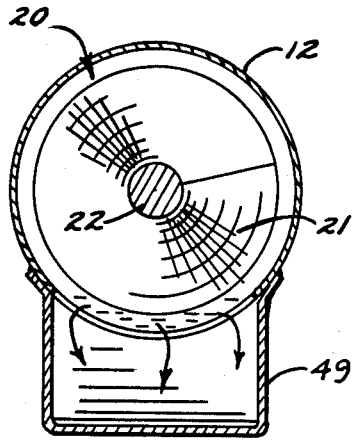
FIG. 3 is a cross-section taken substantially along the line 3—3 of FIG. 2.

The present invention contemplates the provision of a novel machine 10 for breaking open outdated containers 11 of a flowable food product and for recovering the product for use as animal food. While the machine may handle various containers and products, it is especially useful in conjunction with milk in plastic bottles or paperboard cartons, with paperboard or plastic tubs of sour cream, cottage cheese and snack dips and with similar dairy products. Such products are pulled from retail shelves and are returned to the dairy or processor for disposal after expiration of the freshness date.

The machine 10 comprises an elongated tubular barrel 12 which is solidly supported by a cart 13 having various frame members 14, having two front legs 15 with wheels 16 and having two rear legs 17 with wheels 18. To facilitate steering of the cart, the wheels 18 are castor wheels.

Telescoped into the barrel 12 is a screw-type auger 20 (FIG. 1) having a helical flight 21 and a central shaft 22. A bearing 23 on one of the frame members 14 supports the upstream end portion of the shaft for rotation but the opposite end portion of the shaft is not bearing-supported. The shaft is adapted to be rotated by a drive unit 25 comprising an electric motor and a speed reducer.

As shown in FIG. 1, the barrel 12 is supported on the cart 13 at an inclined angle of about twenty degrees relative to horizontal and is inclined in such a direction as to slant upwardly upon progressing from the lower or upstream end portion of the barrel to the upper or downstream end of the barrel. Containers 11 introduced into the barrel 12 are advanced upwardly by the auger 20 while milk and other product extracted from the broken up containers drains downwardly along the inner side of the barrel.

To enable containers 11 to be introduced into the barrel 12 quickly and easily, a hopper 26 is located on the upper side of the upstream end portion of the barrel. The lower end of the hopper is open and communications with the barrel by way of an opening formed by cutting away a top portion of the barrel along substantially the entire length of the hopper. Thus, containers 11 supplied to the hopper 26 drop into the barrel 12 for advancement by the auger 20. An inclined deflecting baffle 27 (FIG. 1) is located in the hopper to help direct the containers to the auger.

Figure 5:
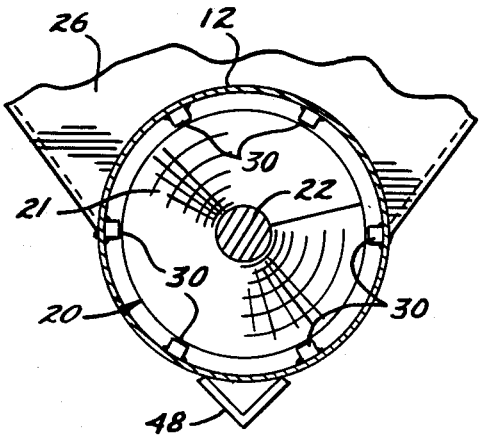

As the containers 11 are advanced upwardly by the auger 20, they are crushed and broken up. For this purpose, that portion of the barrel 12 located downstream of the hopper is equipped with several (herein, six) angularly spaced ribs 30 (FIGS. 1 and 5). The ribs are welded to the inside wall of the barrel and are of such size that the flight 21 of the auger 20 just barely clears a circle extending around the inner faces of the ribs (see FIG. 5). As a result, the ribs restrict the flow of the containers through the barrel and cause the auger to coact with the barrel to break up the containers as the containers are advanced by the auger.

Figure 6:
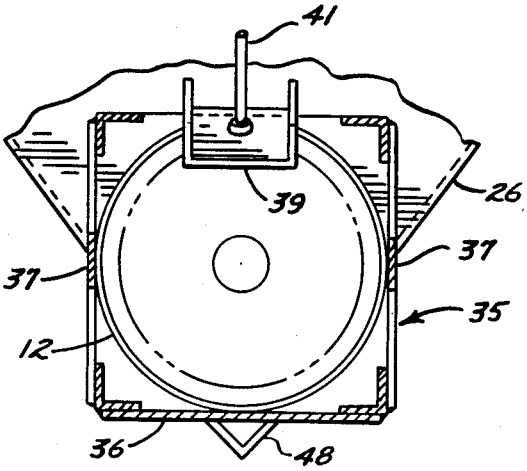

Further in keeping with the invention, a discharge spout 35 is attached to the downstream end of the barrel 12 and its effective cross-sectional area may be adjusted to restrict the flow of containers 11 at a rate correlated with the size and quantity of the containers. Herein, the spout has a rectangular cross-sectional shape and is defined by a solid plate-like bottom wall 36 (FIG. 6) and by two lateral side walls 37 each formed by three vertically spaced slats. The upper side of the spout is defined by a channel-like compactor gate 39 which is pivotally mounted at 40 (FIG. 1) to swing upwardly and downwardly about a transversely extending horizontal axis located between the spout 35 and the barrel 12. An actuator 41 is supported by a bracket 42 attached to and upstanding from the side walls 37 and is pivotally connected to the gate 39. When the actuator is operated to swing the gate counterclockwise about the pivot 40, the gate reduces the effective cross-sectional area of the spout 35. Under such circumstances, the flow of containers 11 is sufficiently restricted to result in effective breaking up of the containers even if the containers are relatively small in size or are fed into the barrel 12 at a relatively slow rate. By operating the actuator 41 to swing the gate 39 clockwise about the pivot 40, the spout 35 is opened up to increase the flow of containers and to enable the machine 10 to handle relatively large containers or a relatively large number of containers in a given time period without choking down. The actuator 41 may be a reciprocating hydraulic or pneumatic cylinder-type actuator, a reciprocating solenoid, a manually adjustable spring actuator or any other type of linear actuator. A particularly suitable actuator is a hand-operated hydraulic jack.

The crushed and broken containers 11 discharged from the spout 35 may be collected in a portable bin 45 (FIG. 1) located beneath the spout. The containers may be burned as fuel if desired.

Figure 4:
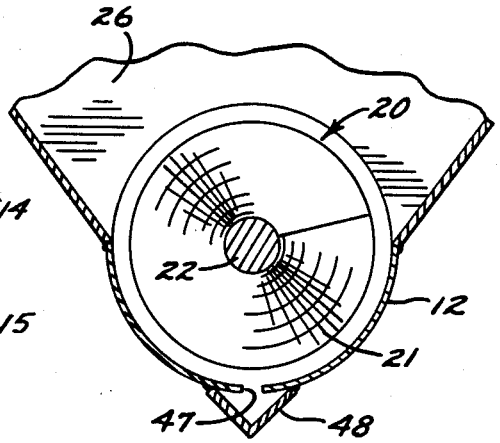
FIGS. 4, 5 and 6 are fragmentary cross-sections taken substantially along the lines 4—4, 5—5 and 6—6, respectively, of FIG. 2.

As shown most clearly in FIG. 4, a slot 47 is formed in that portion of the lower side of the barrel 12 extending beneath the hopper 26 and serves as a drain permitting milk and other product to flow from the barrel once the containers 11 have been broken up. A V-shaped channel member 48 is welded to the underside of the barrel beneath the slot 47 and serves as a trough to direct the milk and other product downwardly toward the upstream end of the barrel. Preferably, the upstream end of the barrel is open so that product also may drain directly from the barrel. A chute-like baffle 49 is positioned adjacent the open lower end of the barrel. As product flows from the barrel and the channel 48, its course is reversed by the baffle and it then is directed downwardly into a holding tank 50 (FIG. 1) located beneath the barrel. The product then may be pumped from the tank to a truck for transport to the farm.

From the foregoing, it will be apparent that the present invention brings to the art a new and improved machine 10 for breaking up food containers 11 to enable recovery of the food product therein. The machine enables dairies to dispose of stale product to farmers without danger of salmonella contamination being brought from the farm to the dairy.

I claim:

1. A machine for extracting flowable food such as dairy products from crushable containers, said machine comprising an auger having an upstream end and a downstream end and supported to rotate about an inclined axis which slants upwardly upon progressing from said upstream end toward said downstream end, power-operated means for rotating said auger in a direction to advance material upwardly from the upstream end portion of said auger toward the downstream end portion thereof, a tubular barrel closely surrounding at least part of said auger, means adjacent the upstream end of said barrel for enabling crushable containers filled with flowable food to be introduced into said barrel for advancement by said auger, means adjacent the downstream end of said barrel for restricting the advance of said containers thereby to cause said auger to coact with said barrel to crush and break up said containers and release said food, the upstream end of said barrel being open to allow food to drain from the upstream end of the barrel, baffle means adjacent the upstream end of said barrel for reversing the flow of food draining from the barrel and for directing such flow downwardly beneath the barrel, and a tank below said barrel between the ends thereof for collecting the food flowing from said baffle means.

2. A machine as defined in claim 1 in which said means adjacent said downstream end of said barrel comprise elongated ribs spaced angularly around the inner side of said barrel.

3. A machine as defined in claim 1 in which said means adjacent said downstream end of said barrel comprise a spout at the downstream end of said barrel and having a discharge end, and selectively operable means for varying the effective cross-sectional area of said discharge end in correlation with the type and quantity of the containers being advanced by said auger.

4. A machine as defined in claim 1 in which said means adjacent said upstream end of said barrel comprise a hopper located at the upper side of said barrel and having a lower end communicating with said barrel.

5. A machine as defined in claim 1 further including a slot in the lower side of said barrel, and channel means located beneath said slot for directing food from said slot along said barrel toward the upstream end portion thereof.

6. A machine as defined in claim 1 further including a wheeled cart supporting said barrel.

7. A machine for extracting flowable food such as dairy products from crushable containers, said machine comprising an auger having an upstream end and a downstream end and supported to rotate about an inclined axis which slants upwardly upon progressing from said upstream end toward said downstream end, power-operated means for rotating said auger in a direction to advance material upwardly from the upstream end portion of said auger toward the downstream end portion thereof, a tubular barrel closely surrounding at least part of said auger, means adjacent the upstream end of said barrel for enabling crushable containers filled with flowable food to be introduced into said barrel for advancement by said auger, means adjacent the downstream end of said barrel for restricting the advance of said containers thereby to cause said auger to coact with said barrel to crush and break up said containers and release said food, said restricting means comprising a spout at the downstream end of said barrel and further comprising selectively operable means for varying the effective cross-sectional area of said spout in correlation with the type and quantity of containers being advanced by said auger, means enabling said food to drain from said barrel, and means below said barrel for collecting the food drained from the barrel.

8. A machine as defined in claim 7 in which said means adjacent said downstream end of said barrel further comprise elongated ribs spaced angularly around the inner side of said barrel.

9. A machine for extracting flowable food such as dairy products from crushable containers, said machine comprising an auger having an upstream end and a downstream end and supported to rotate about an inclined axis which slants upwardly upon progressing from said upstream end toward said downstream end, power-operated means for rotating said auger in a direction to advance material upwardly from the upstream end portion of said auger toward the downstream end portion thereof, a tubular barrel closely surrounding at least part of said auger, a hopper located on the upper side of said barrel near the upstream end thereof and having a lower end communicating with said barrel to enable crushed containers filled with flowable food to be introduced into said barrel for advancement by said auger, a series of elongated ribs spaced around the inner side of the downstream end portion of said barrel and operable to restrict the advance of said containers through said barrel thereby to cause said auger to coact with said barrel to crush and break up said containers to release said food, a discharge spout adjacent the downstream end of said barrel and communicating with said barrel, selectively operable means for varying the effective cross-sectional area of said discharge spout in correlation with the type and quantity of containers being advanced by said auger, and means below said barrel for collecting the food drained from said barrel.

10. A machine as defined in claim 9 in which said selectively operable means comprise a gate supported to move between more nearly open and more nearly closed positions, and means for shifting said gate between said positions.

11. A machine as defined in claim 10 in which said gate is supported to pivot between said positions about a generally horizontal axis extending transversely of said barrel across the upper side thereof and adjacent the downstream end of the barrel.

12. A machine as defined in claim 10 in which said a slot is formed in the lower side of said barrel, and channel means located beneath said slot for directing food from said slot along said barrel toward the upstream and portion thereof.

13. A machine as defined in claim 12 in which the upstream end of said barrel is open to allow food to flow from the upstream end of the barrel, and baffle means adjacent the upstream end of said barrel for reversing the flow of food from said barrel and said channel and for directing such flow downwardly beneath the barrel, said collecting means comprising a tank located beneath said barrel to receive the flow from said baffle means.

* * * * *